United States Patent [19]

Jameel et al.

[11] 4,243,963

[45] Jan. 6, 1981

[54] CONSTRUCTION OF A PRINTED WIRING CARD MOUNTABLE REED RELAY

[75] Inventors: Khaja M. Jameel, Glen Ellyn; James V. Koppensteiner, Chicago, both of Ill.

[73] Assignee: GTE Automatic Electric Laboratories Incorporated, North Lake, Ill.

[21] Appl. No.: 26,141

[22] Filed: Apr. 2, 1979

[51] Int. Cl.[3] ..... H01H 1/66

[52] U.S. Cl. ..... 335/151; 335/154

[58] Field of Search ..... 335/151, 152, 153, 154

[56] References Cited

U.S. PATENT DOCUMENTS

| | | | |
|---|---|---|---|
| 2,903,536 | 9/1959 | McBrain | 335/154 |
| 2,925,646 | 2/1960 | Walsh | 335/151 |
| 3,263,043 | 7/1966 | McKeon et al. | 335/154 |
| 3,320,559 | 5/1967 | Morrison | 335/151 |

*Primary Examiner*—George Harris

*Attorney, Agent, or Firm*—Robert J. Black; Anthony Miologos

[57] ABSTRACT

A reed relay is constructed by first depositing a layer of an electrically conductive material substantially over an encapsulated reed switch. Terminals are laser welded to the conductive layer and a laser beam is used to cut a continuous pitch spiral from the conductive layer to simulate a conventional control winding.

5 Claims, 2 Drawing Figures

CONSTRUCTION OF A PRINTED WIRING CARD MOUNTABLE REED RELAY

FIELD OF THE INVENTION

This invention relates generally to electromagnetic devices and more particularly to an improved reed relay structure and method for making it.

DESCRIPTION OF THE PRIOR ART

It has been an object of reed relay manufacturers to simplify the construction of reed relays and to reduce their cost and size, thereby making them more suitable where economy is essential and space is a premium. Efforts toward this end have been frustrated because prior to the present invention the only satisfactory approach for securing a coil and corresponding coil terminals to a reed relay capsule was through the use of a molded bobbin or frame structure. The typical relay bobbin includes a spool portion with a flange at each end for supporting a coil and slots in which terminals are inserted. Although bobbins are commonly used and have found wide acceptance in the industry, they add to the size of the relay and increase the magnetic reluctance by increasing the distance that the coil is from the reeds. Consequently, some manufacturers have placed the coil directly on the capsule to avoid the wall thickness of the bobbin and thereby reduce the reluctance in the relay structure, and then place a casing around the coil to prevent it from slipping on the capsule. An example of such a relay device is disclosed in U.S. Pat. No. 2,903,536 to J. E. McBrian, issued Sept. 8, 1959.

Still another technique used is found in U.S. Pat. No. 3,263,043 to P. E. McKeon issued on July 26, 1966. This relay features an encapsulated reed switch which employes spool heads made of heat shrinkable material. The spool heads are placed at opposite ends of the coil and over coil terminals and secured rigidly to the capsule by heating them to their shrinkable temperature.

The aformentioned reed relays have not gain favorable acceptance within the field, because of the difficulty of machine winding a coil about the capsule. The winding was accomplished by clipping one of the external blade ends of the reed capsule in a chuck of a winding machine and the capsule spun, wrapping the wire about it. This method greatly stressed the glass to metal seals at the capsule ends subjecting this area to a sheer stress by virtue of the tension on the wire. The result was considerable breakage of the capsules.

Accordingly it is an object of the present invention to provide a new method and technique for producing a reed capsule having a coil placed directly on the reed capsule envelope.

SUMMARY OF THE INVENTION

To accomplish its object, the present invention contemplates the use of a reed relay consisting of a pair of reed blades including contact portions housed within an included envelope. The outside surface of the envelope with the exception of its extremities, is coated with a thin layer of high conductivity copper or other electrically conductive material. Termination rings, including terminal posts are welded to the conductive surface, one at each end of the glass envelope. Using a laser beam, a spiral is cut through the copper layer leaving a spiral strand to simulate a conventional control winding. The finished reed capsule element may then be directly soldered to a printed wiring card, or mounted in any of a number of other conventional ways.

Due to its compact size, a large number of such switching elements could be assembled on a printed wiring card using a relatively small surface area of the card. In addition, due to its low profile several cards could be assemblied in a given file leading to a very high packaging density.

BRIEF DESCRIPTION OF THE DRAWINGS

A better understanding of the invention may be had from the consideration of the following detailed description taken in the conjunction with the accompanying drawings in which.

DESCRIPTION OF THE PREFERRED EMBODIMENT

Figure 1:
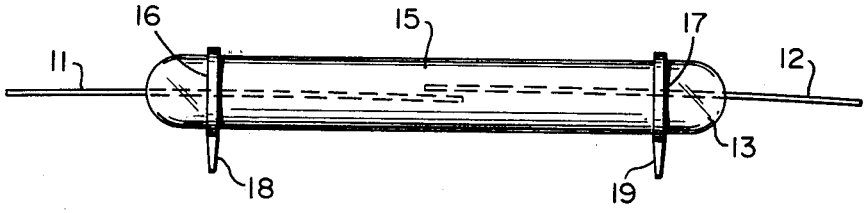
FIG. 1 is a side elevational view of a conductively coated reed capsule switching element and including winding termination rings before laser cutting in accordance with the present invention described herein.

The reed relay illustrated in FIG. 1, comprises a pair of a reed blades 11 and 12 sealed in a glass envelope 13. The free ends of the reed blades 11 and 12 overlap and form contacts. The exterior surface of the glass envelope 13, with the exception of its extremities, is coated with a thin layer of high conductivity copper 15, approximately 0.0003 inch to 0.0005 inch in thickness. The copper is vacuum evaporated on the glass envelope permanently bonding the conductive layer to the glass. A pair of winding termination rings 16 and 17 are slipped over each of the glass envelope ends and are placed on the copper layer ends. Each winding termination ring 16, 17 includes a terminal post 18, 19 respectively. The terminal posts 18, 19 are adapted to be inserted into respective locations on a printed wiring card 21 as shown on FIG. 2. Each terminal ring is then laser welded to the copper layer.

Using a laser and employing one of the known techniques for laser cutting such as those taught by U.S. Pat. Nos. 3,293,587, 3,534,472 and 4,065,656, a fine pitch helical spiral 20 is cut on the copper surface as shown on FIG. 2. The laser beam removes the selected areas of copper from the glass surface leaving a fine strand spiral to simulate a conventional copper winding.

Figure 2:
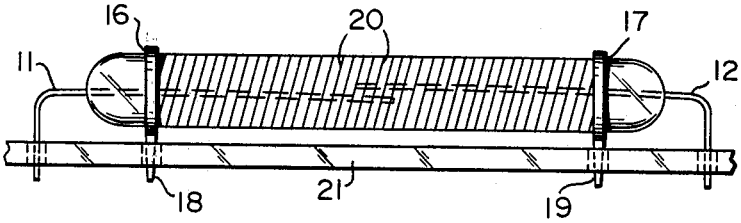
FIG. 2 is a side elevational view of the completed reed capsules switching element after laser cutting, mounted on a printed wiring card.

The now completed reed relay may be mounted to a printing printed wiring card 21 as shown on FIG. 2 with terminal posts 18, 19 providing an electrical path for an excitation voltage to coil 20 and the reed blades 11 and 12 electrically connected to external circuitry.

The present invention has been described with reference to a specific embodiment thereof, for the purpose of illustrating the manner in which the invention may be used to advantage, it will be appreciated by those skilled in the art that the invention is not limited thereto. Accordingly, any and all modifications, variations, or equivalent arrangements which may occur to those skilled in the art should be considered to be within the scope of the invention.

What is claimed is:

1. An electromagnetic switching device including an elongated capsule of dielectric material and a plurality of switching contacts located within and supported by said capsule, said electromagnetic switching device comprising;

a helix of conductive material bonded to a substantial portion of the exterior periphery of said capsule, said helix including first and second termination ends; and first and second terminals bonded to said first and second termination ends respectively.

2. An electromagnetic switching device as recited in claim 1, wherein: there is included at least a pair of terminals, each terminal integrally joined to at least one of said switching contacts, said terminals oriented outwardly of said capsule and adapted to be mounted to a printed circuit board electrically connecting said integrally joined switching contacts.

3. An electromagnetic switching device as recited in claim 1, wherein: said helix is formed from a sleeve of conductive material vacuum evaporated on said capsule.

4. An electromagnetic switching device as recited in claim 3, wherein: said sleeve is copper and said copper sleeve is laser cut in a continuous path between said first and second terminals removing selected areas of said copper, forming said helix and producing a control coil about said capsule.

5. An electromagnetic switching device as recited in claim 2, wherein: each of said first and second terminals are annular in structure and each include a terminal post, each terminal post adapted to be mounted to said printed circuit board electrically connecting said helix.

* * * * *